US005964230A

United States Patent [19]

Voloshin et al.

[11] Patent Number: 5,964,230

[45] Date of Patent: Oct. 12, 1999

[54] SOLVENT PURGE MECHANISM

[75] Inventors: George Oleg Voloshin, San Diego; Robert Sam Zorich, Carlsbad, both of Calif.

[73] Assignee: Air Products and Chemicals, Inc., Allentown, Pa.

[21] Appl. No.: 08/944,907

[22] Filed: Oct. 6, 1997

[51] Int. Cl.[6] ..... B08B 3/04; B08B 9/00

[52] U.S. Cl. ..... 134/98.1; 134/102.2; 134/104.1; 134/105; 134/169 R; 134/169 C

[58] Field of Search ..... 134/102.2, 104.1, 134/105, 169 R, 169 C, 98.1

[56] References Cited

U.S. PATENT DOCUMENTS

| | | | |
|---|---|---|---|
| 2,808,025 | 10/1957 | Graves | 134/169 C X |
| 3,128,779 | 4/1964 | Morris | 134/169 R X |
| 3,385,265 | 5/1968 | Schrader | 134/169 R X |
| 4,357,175 | 11/1982 | Buffington et al. | 134/10 |
| 4,832,753 | 5/1989 | Cherry et al. | 134/22.18 |
| 4,865,061 | 9/1989 | Fowler et al. | 134/108 |
| 4,871,416 | 10/1989 | Fukuda | 156/635 |
| 5,045,117 | 9/1991 | Witherell | 134/21 |
| 5,051,135 | 9/1991 | Tanaka et al. | 134/10 |
| 5,106,404 | 4/1992 | Grant | 55/195 |
| 5,108,582 | 4/1992 | Foutsitzis et al. | 208/138 |
| 5,115,576 | 5/1992 | Roberson, Jr. et al. | 34/15 |
| 5,240,507 | 8/1993 | Gray et al. | 134/21 |
| 5,304,253 | 4/1994 | Grant | 134/26 |
| 5,339,844 | 8/1994 | Stanford, Jr. et al. | 134/107 |
| 5,425,183 | 6/1995 | Taylor | 34/73 |
| 5,469,876 | 11/1995 | Gray et al. | 134/105 |
| 5,509,431 | 4/1996 | Smith, Jr. et al. | 134/95.1 |
| 5,538,025 | 7/1996 | Gray et al. | 134/105 |
| 5,562,883 | 10/1996 | Salisbury et al. | 422/133 |

FOREIGN PATENT DOCUMENTS

| | | | |
|---|---|---|---|
| 8115886 | 5/1996 | Japan | H01L 21/205 |

*Primary Examiner*—Philip R. Coe
*Attorney, Agent, or Firm*—Geoffrey L. Chase

[57] ABSTRACT

Apparatus and process for solvent purging a process line of process chemical in a process chemical delivery system typically used to dispense toxic chemicals from replaceable process chemical containers in the electronic fabrication industry.

12 Claims, 1 Drawing Sheet

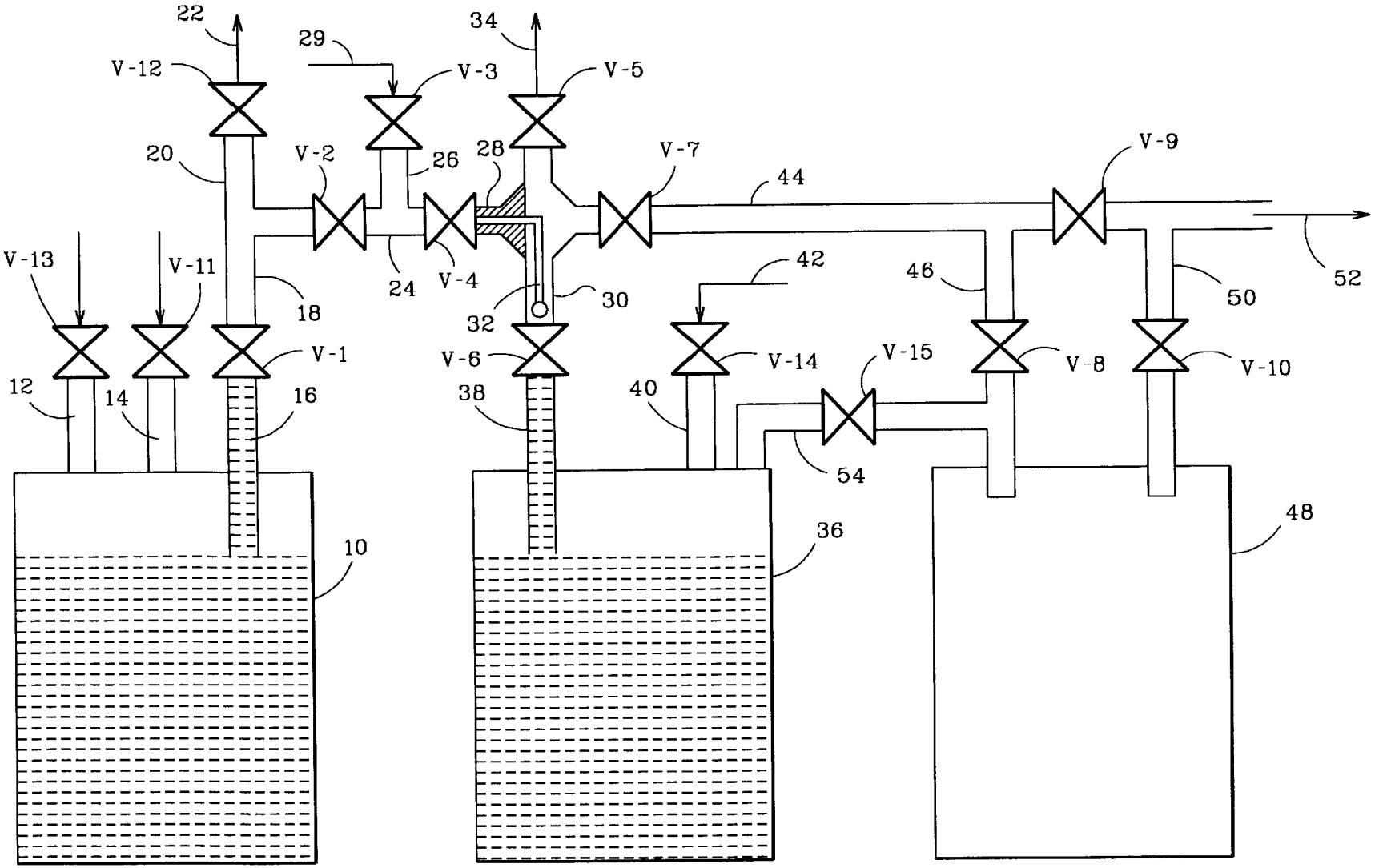
52
50
V-10
48
V-9
V-8
46
V-15
54
36
44
42
V-14
40
V-7
V-5
30
34
28
32
V-6
38
V-3
26
V-4
24
29
V-2
18
V-1
16
10
22
V-12
20
V-11
14
V-13
12

SOLVENT PURGE MECHANISM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention is directed to the field of process chemical delivery in the electronics industry and other applications requiring high purity chemical delivery. More specifically, the present invention is directed to apparatus and processes for the cleaning of process chemical delivery lines, containers and associated apparatus, particularly during changeout of process chemical or process chemical containers in such process chemical delivery lines.

Evacuation and gas purge of process chemical lines has been used to remove residual chemicals from delivery lines. Both vacuum draw and inert gas purge are successful in quickly removing high volatility chemicals, but are not effective with low volatility chemicals. Safety is a problem when extracting highly toxic materials.

Use of solvents to remove residual chemicals is not new. Various patents have sought to clean systems using solvents.

U.S. Pat. No. 5,045,117 describes a method and apparatus for cleaning printed wiring assemblies with a solvent and vacuum action.

U.S. Pat. No. 5,115,576 discloses an apparatus and method of cleaning semiconductor wafers using isopropyl alcohol solvent.

Additional patents regarding solvent cleaning include; U.S. Pat. No. 4,357,175, U.S. Pat. No. 4,832,753, U.S. Pat. No. 4,865,061, U.S. Pat. No. 4,871,416, U.S. Pat. No. 5,051,135, U.S. Pat. No. 5,106,404, U.S. Pat. No. 5,108,582, U.S. Pat. No. 5,240,507, U.S. Pat. No. 5,304,253, U.S. Pat. No. 5,339,844, U.S. Pat. No. 5,425,183, U.S. Pat. No. 5,469,876, U.S. Pat. No. 5,509,431, U.S. Pat. No. 5,538,025, U.S. Pat. No. 5,562,883 and Japanese 8-115886.

However, the present invention simplifies the process and apparatus of the prior art and reduces the size and complexity of the solvent purge system and permits the purging of the interior volume of a process line and also permits the solvent purge volume to be minimized, as will be set forth in greater detail below.

BRIEF SUMMARY OF THE INVENTION

The present invention is an apparatus for cleaning the interior of a process chemical distribution system, comprising:

a) a process line connected to a source of process chemical and a downstream process chemical use station, the process line having a process valve to control the passage of the process chemical through the process line;

b) a source of solvent capable of at least partially dissolving the process chemical;

c) a vent line connected to the process line, capable of receiving the solvent and having a vent valve for controlling removal of solvent through the vent line; and d) a solvent delivery line connected to the source of solvent and to the process line, having an outlet which is coaxially aligned inside the process line to permit dispensing of solvent from the solvent delivery line into the process line and having a solvent valve for controlling the dispensing of solvent from the source of solvent through the solvent delivery line into the process line.

Preferably, the process valve is a first process valve adjacent the source of process chemical and a second process valve adjacent the process chemical use station and the solvent delivery line is connected to the process line between the first and second valve.

Preferably, a source of purge gas is controllably connected to the solvent delivery line.

Preferably, the solvent delivery line has a first solvent valve adjacent the source of solvent and a second solvent valve adjacent the process line and the source of purge gas is connected to the solvent delivery line between the first and second solvent valve.

Preferably, the vent line is connected to a first source of vacuum.

Preferably, a vent storage vessel is connected to the vent line between the process line connection and the first source of vacuum.

Preferably, the vent valve has upstream and downstream orifices and the vent storage vessel is controllably connected to the vent line adjacent the upstream orifice and adjacent the downstream orifice.

Preferably, the source of solvent is connected to a source of push gas through a push gas valve.

Preferably, the solvent delivery line has a third solvent valve between the first solvent valve and the source of solvent.

Preferably, a second source of vacuum is connected to the solvent delivery line between the third solvent valve and the first solvent valve.

Preferably, the apparatus has a heating means to heat the apparatus and any process chemical contained therein.

In a preferred embodiment, the present invention is an apparatus for cleaning the interior of a process chemical distribution system, comprising:

a) a process line connected to a source of process chemical and a downstream process chemical use station, the process line having a first process valve adjacent the source of process chemical and a second process valve adjacent the process chemical use station to control the passage of the process chemical through the process line;

b) a source of solvent capable of at least partially dissolving the process chemical, the source of solvent connected to a source of push gas through a push gas valve;

c) a vent line connected to the process line, capable of receiving the solvent and having a vent valve for controlling removal of solvent through the vent line, the vent valve having upstream and downstream orifices and a vent storage vessel controllably connected to the vent line adjacent the upstream orifice and adjacent the downstream orifice; and d) a solvent delivery line connected to the source of solvent and to the process line, having an outlet which is coaxially aligned inside the process line to permit dispensing of solvent from the solvent delivery line into the process line and having a first solvent valve for controlling the dispensing of solvent from the source of solvent through the solvent delivery line into the process line and having a second solvent valve adjacent the first solvent valve and a third solvent valve adjacent the process line and a source of purge gas is connected to the solvent delivery line between the second and third solvent valve.

Preferably, the apparatus has a heating means to heat the apparatus and any process chemical contained therein.

Preferably, at least a portion of the apparatus is constructed of a material selected from the group consisting of stainless steel, Inconel alloy, titanium, Hastalloy alloy, Teflon plastic, quartz, glass and mixtures thereof.

The present invention is also a process of cleaning the interior of a process chemical distribution system having a process line connected to a source of process chemical and a downstream process chemical use station, the process line having a process valve to control the passage of the process chemical through the process line; a source of solvent capable of at least partially dissolving the process chemical; a vent line connected to the process line, capable of receiving the solvent and having a vent valve for controlling removal of solvent through the vent line; and a solvent delivery line connected to the source of solvent and to the process line, having an outlet to permit dispensing of solvent from the solvent delivery line into the process line and having a solvent valve for controlling the dispensing of solvent from the source of solvent through the solvent delivery line into the process line, comprising the steps of:

a) introducing a solvent for the process chemical into the process line through the solvent delivery line;

b) removing the solvent and the process chemical from the process line through the vent line;

c) repeating steps a) and b) until the process line has been cleaned.

Preferably, the outlet of said solvent delivery line is coaxially aligned inside the process line and the solvent is introduced into the process line through the coaxially aligned outlet.

Preferably, the process line is evacuated through the vent line prior to the introduction of solvent into the process line.

Preferably, the solvent and the process chemical are removed using purge gas from a source of purge gas connected to the solvent delivery line.

Preferably, a source of vacuum connected to the vent line is used to assist in the removal of the solvent and the process chemical.

Preferably, at least a portion of the process chemical in the process line is initially returned to the source of process chemical before the solvent is introduced into the process line.

Preferably, the process line is contacted with dry purge gas in step b) until the process line has been cleaned of solvent and process chemical.

BRIEF DESCRIPTION OF SEVERAL VIEWS OF THE DRAWINGS

FIG. 1 is a schematic illustration of a preferred embodiment of the present invention.

DETAILED DESCRIPTION OF THE INVENTION

The present invention is an apparatus and process of flushing and/or purging a process chemical delivery line, system or source container to remove residual chemical from the line, system or container by means of flushing with gas, supercritical fluids, acids and/or liquid solvent. The present invention results in removal of low volatility or toxic chemical materials from delivery lines or chemical vapor deposition systems or chemical refill systems when changing chemical sources, source containers, and for making connections or for system disassembly. The present invention provides the ability to do solvent, gas purge, and vacuum draw combinations in one apparatus. It also permits efficient removal of multi-component chemicals from delivery lines without using vacuum-pressure cycle purges only. The present invention also permits the use of suitable acids as the solvent when process lines contain insoluble contaminants such as metal oxides formed when process lines are exposed to the atmosphere and oxygen reacts with process chemical.

When a chemical source container is disconnected from a system, there could be residual chemical in the line. This residual material may remain in the line due to low volatility or wetting of the surface of the line. If the residual chemical material is air- or moisture-sensitive, upon disassembly or disconnecting components, the delivery system becomes contaminated. The residual chemical remaining in delivery lines may be incompatible with introduction of a new chemical source, or be reactive with the atmosphere. In addition, the operator may be exposed to residual chemicals in the lines. Multi-component chemicals, such as barium/strontium/titanate solvent blends (BST) and similar mixtures, may precipitate solid components, when only vacuum is used to clean the line. The present invention reduces or removes these difficulties.

Also, when chemical source containers, such as bubblers, are returned to the manufacturer, there is a need to completely clean and flush the source container prior to its being opened for further inspection and processing. The present invention provides an apparatus for this cleaning process.

The main difficulty comes from chemicals whose vapor pressures are too low to be effectively removed using standard vacuum/pressure cycle purge techniques. This leads to increased particulation and operator exposure to process chemicals. Current designs are not integrated and result in large volumes of unpurged chemical in a refill system or process tool.

In a standard vacuum purge operation, the process chemical will not be effectively removed from the system unless the vacuum pressure is below the vapor pressure of the chemical. Typically, the internal pressure seen when processing using a standard vacuum purge operation is an equilibrium average between the base pressure of the vacuum pump and the vapor pressure of the chemical. When the vapor pressure of the liquid chemical is below or near the base pressure of the vacuum source, then little or no chemical removal takes place, and during exchange of the chemical supply vessel, the liquid chemical is exposed to the outside environment.

Many of these compounds are oxygen or moisture sensitive and will create particulate matter or are hazardous and become safety concerns if an operator is exposed to the chemical fumes or to the byproducts of the reaction of the chemical with air. In some cases, pyrophoric materials are used, and inadequate purging can lead to flammable situations. In addition, a mechanical cleaning of the internal surfaces of the process tool or process line can be accomplished through this apparatus when used with supercritical fluids, such as $CO_2$.

This solvent purge manifold completely removes traces of process chemical from the delivery lines, regardless of chemical volatility, by introducing a solvent suitable for the process chemical into the space immediately downstream of the chemical supply vessel. Each chemical may have its own optimal solvent, for example, 1,1,1,5,5,5-hexafluoro-2,4-pentanedionato copper (I) trimethylvinylsilane is most easily removed using trimethylvinylsilane, while trimethylphosphate can be removed using methanol or isopropyl alcohol.

Alternatively, the "solvent" could be an acid for removal of metal oxides and other byproducts from the process lines that are not removable with traditional solvents. An appropriate acid to be used in place of or as the solvent of the process would be an acid selected for the particular material to be removed while being sufficiently unreactive with the materials of construction of the process lines and the related hardware or apparatus.

The present invention can be used for valve post cleaning processes by using the apparatus to inject solvent into the exposed areas of the valve body. It can also be used as a mechanism for in-place cleaning of the source container that originally held the process chemical. This apparatus can also be used to insert solvent into the tool delivery system to permit flushing of direct liquid injection mass flow controllers and process chambers. Therefore, the process line of the present apparatus to which the solvent delivery line is attached or associated may be near or attached to a source of process chemical (i.e., a bubbler or storage container), a downstream process chemical use station (i.e., a tool or reaction chamber), or a process chemical control device (i.e., mass flow controller or valve).

In a preferred embodiment, the present invention is a solvent purge manifold, providing inlets for chemical solvent, an inert gas, vacuum sources and spent solvent and process chemical. The apparatus also uses a solvent source container, a solvent vent storage vessel, an inert gas source, a vacuum source, and a set of valves to direct the flow of solvent, inert gas, and vacuum in the correct sequence. Optionally, it may contain a pump for the creation of supercritical fluids and means for heating the apparatus by resistance heat, infrared radiation, microwave or similar heating means (particularly for low volatility process chemicals).

A key attribute of the solvent purge manifold is the internal coaxial line. This is used to direct the solvent into the valve of the process chemical source container that is being replaced (or alternatively can be installed to face the valve leading to the delivery lines and/or process chamber). By directing the solvent into this area under pressure, a mechanical scrubbing aspect to the cleaning process is added, ensuring complete chemical removal. This effect is amplified through the use of supercritical fluid injection.

The apparatus of the present invention is installed between the process chemical source container and the process chamber or delivery lines of the refill system, depending on its exact installation.

The general process sequence for the apparatus is as follows:

a) Valves are operated to push the process chemical back into the process chemical source container or into a suitable vent storage vessel.

b) Valves above and below the purge manifold are closed to isolate the manifold from the process chemical and the delivery lines or process tool/chamber.

c) Solvent is directed from the solvent source vessel into the wetted area between the source of the chemical and the process tool through valves. This solvent dissolves any chemical adhering to the tube walls through surface tension and moves it into the drain vessel when the solvent is removed through pressurizing with inert gas, potentially with the assistance of vacuum.

d) After the solvent is drained, the plumbing segment is vacuum/pressure cycle purged to remove traces of solvent. The solvent purge and vacuum/pressure cycles are repeated as many times as is necessary for complete chemical removal. The inert gas can be used to physically push the solvent out of the manifold with or without the use of vacuum applied simultaneously to the input of the inert gas.

e) In the event a container cleaning is required, suitable piping can be installed to permit the direction of the solvent into the source container for efficient and complete removal of the process chemical from the source container.

An important feature of the apparatus includes the use of a coaxial central line for solvent chemical and inert gas flow from the solvent delivery line to the process line. This line is preferably mounted inside of a suitable stainless steel fitting and welded to prevent atmospheric leakage. Alternatively, the coaxial line may be machined as one piece within the stainless steel fitting. Valves are located on the coaxial inner solvent delivery line and on at least one end of the coaxially outer process chemical line. Valves are also located immediately above and below the process chemical line in order to isolate the solvent purge manifold from the process chemical container and from the rest of the delivery line or process tool/chamber. By use of the apparatus of the present invention, one can increase the directed face velocity of the gas or liquid solvent to enhance the removal efficiency. The cavity surrounding the inner coaxial solvent delivery line is scaled to match the cross sectional area of the outer coaxial tubing of the process line to minimize pressure and flow variations.

The apparatus is typically constructed of 316L stainless steel for ultrapure chemical use, with suitable bellows or diaphragm valves placed on each port. Valve seat materials are selected based on their reactivity with the process chemical and solvent to be used. Other materials, including other varieties of stainless steel, or exotic materials, (eg. Inconel, titanium, or Hastalloy, etc.) may be used depending on the process chemical and solvent required. For use with selected corrosive materials, the use of appropriate non-metallic materials can also be implemented (eg. Teflon, quartz or glass).

The present invention provides an apparatus and process for removal of low volatility or highly toxic compounds from the internal space of a delivery line or process tool or process chemical source container. These process chemicals include chemicals, such as: 1,1,1,5,5,5-hexafluoro-2,4-pentanedionato copper(l) trimethylvinylsilane, tantalum pentethoxide, tetrakis(diethylamido)titanium, tetrakis (dimethylamido)titanium, dimethylaluminumhydride, trimethylphosphite, triethylphosphate, barium-strontium-titanium precursors, and other materials that have vapor pressures below what can be efficiently removed with a standard vacuum purge process.

A preferred embodiment of the present invention is illustrated in FIG. 1. A source container of solvent 10 is connected to a source of push gas through line 12 and push gas valve $V_3$. The push gas is a pressurized high purity inert gas, such as; nitrogen, helium or argon used to push solvent through various process lines. The container 10 is filled with additional solvent as necessary through line 14 and valve $V_{11}$. Solvent is dispensed from the container 10 through line 16, third solvent valve $V_1$, line 18, first solvent valve $V_2$, line 24, second solvent valve $V_4$ and finally solvent delivery line 28, which ends in a coaxially internal discharge nozzle 32 inside process line 30. Solvent delivery line 28, including lines 24, 18 and 16, is also connected to a second source of vacuum 22 through valve $V_{12}$, and line 20, as well as a source of purge gas 29, which is connected controllably to line 24 through valve $V_3$ and line 26. A source of process chemical 36 is provided in a suitable container, which in the electronics industry is typically a bubbler or a direct liquid injection device. The process chemical is delivered by the pressure of an inert gas 42 controllably delivered through valve $V_{14}$ and line 40. As the inert gas 42 pressurizes the source 36, process chemical is delivered through line 38 and first process valve $V_6$ to process line 30. Normally, process line delivers process chemical through second process valve $V_5$ to a downstream process chemical use station or tool 34. When it is appropriate to clean out process line 30, such as during down time, changeout of the container 36, maintenance of the system or change in the type of chemical being utilized, it is necessary to remove residual process chemical from the process line 30. Initially, this is done through vent valve $V_7$ and vent line 44. Vent line 44 is controllably connected to a first source of vacuum 52 either directly through vent valve $V_9$ having an upstream orifice near the vent line 44 and a downstream orifice near the first source of vacuum 52. The vent line 44 may also be controllably connected to the first source of vacuum 52 through line 46, valve $V_8$, vent storage vessel 48, valve $V_{10}$ and line 50, which connects to said first source of vacuum 52. Alternatively, the vent line 44 may be connected to the source of process chemical 36 via valve $V_{15}$ and line 54 so as to return process chemical to source container 36. The operation of this solvent purge manifold system will be described in the ensuing example and test runs.

The following example demonstrates the apparatus of the present invention with reference to FIG. 1.

EXAMPLE

The objective of this experiment is to fill up the solvent purge manifold with 1,1,1,5,5,5-hexafluoro-2,4-pentanedionato copper(I) trimethylvinylsilane (process chemical), and then to see how many cycles of trimethylvinylsilane (solvent)-nitrogen-vacuum purges it will take to get all of the 1,1,1,5,5,5-hexafluoro-2,4-pentanedionato copper(I) trimethylvinylsilane out of the manifold.

The following is the test sequence to first charge and then clean the apparatus:

1. Open $V_{12}$, $V_4$, $V_2$ and $V_7$ to evacuate the system.
2. Close $V_{12}$, $V_4$, $V_2$ and $V_7$ to isolate components.
3. Open $V_6$, $V_{14}$ to charge purge manifold with 1,1,1,5,5,5-hexafluoro-2,4-pentanedionato copper(I) trimethylvinylsilane.
4. Close $V_6$, $V_{14}$.
5. Open $V_3$, $V_4$, $V_6$ to push back 1,1,1,5,5,5-hexafluoro-2,4-pentanedionato copper(I) trimethylvinylsilane into the vessel 36.
6. Close $V_3$, $V_4$, $V_6$.

Next the following steps are performed to flush out the residual process chemical from the manifold.

7. Open $V_{12}$ to evacuate up to the solvent purge manifold.
8. Close $V_{12}$.
9. Open $V_1$, $V_{13}$ to charge with trimethylvinylsilane (solvent) up to the solvent purge manifold.
10. Open $V_7$, $V_9$ to evacuate the solvent purge manifold.
11. Close $V_7$, $V_9$.
12. Open $V_2$ and $V_4$ to introduce trimethylvinylsilane into the manifold.
13. Close $V_2$ and $V_4$.
14. Open $V_3$, $V_4$, $V_7$, $V_8$ and $V_{10}$ to remove the process chemical and solvent from the system.
15. Repeat steps 7 to 14.
16. Observe evacuated solvent/process chemical for color change of liquid.

Repeat until clear (absence of process chemical).

Test #1

1. Purge manifold was filled with process chemical.
2. Process chemical was pushed back into the source container of the process chemical.
3. Solvent was charged into the manifold.
4. Process chemical/solvent mixture color was observed.
5. This process chemical/solvent liquid was vacuum/nitrogen purged from the system.
6. Flush repeated.

Observations:

On the first flush, the liquid looked light green (indicating residual process chemical). On the second flush the liquid looked colorless/clear (indicating the absence of process chemical).

Test #2

This test was done exactly the same as Test #1 to show reproducibility. Results were the same as Test #1. The second flush liquid looked clear and colorless (indicating an absence of process chemical).

Test #3

For this test, process chemical was charged into the purge manifold and allowed to sit for 90 minutes.

The flush procedure was repeated as in Tests #1 and #2 above.

Result:

On the second flush, the liquid looked clear and colorless (indicating an absence of process chemical).

Test #4

On this test, the objective was to see how many flushes of solvent it would take to do the following:

The solvent purge manifold was charged with process chemical and the chemical was left in the manifold. Therefore, the process chemical was not pushed back into the source container for process chemical.

The first flush looked very green-much darker than Tests #1 through #3 (indicating presence of process chemical).

The second flush showed a very barely noticeable tint of green in the solvent (indicating reduced presence of process chemical).

The third flush looked clear and colorless (indicating an absence of process chemical).

Conclusion:

If the process solvent is not pushed back into the process chemical source container, but rather is left up the solvent purge manifold, it took one additional flush of solvent to clear the system.

Additional Observation:

The valve on the process chemical source container that was previously contaminated with chemical looked clean. Looking into the valve cavity, no visible contamination was observed.

The use of the present invention provides several important benefits: a) it permits the use of a vacuum/pressure cycle purge to remove all traces of the remaining solvent from the process chemical lines, since that could pose a process or health hazard; b) it utilizes a special coaxial delivery line that provides pressurized solvent to permit the cleaning of the valve volume that cannot be easily reached by other methods; c) it is designed to minimize the volume of solvent required for purging (current methods require purging entire legs of plumbing and are currently ineffective at complete removal in all cases); d) it provides for the existence of both a solvent source and solvent retrieval vessel or vent storage vessel, isolating contaminated chemical from the rest of the system, and permitting off-line replacement of these vessels without incurring further downtime; e) it provides a means for post process cleaning of the valve body during a chemical fill or vessel cleaning operation at the chemical supply manufacturer; f) it permits the introduction of supercritical fluids into the process system for additional cleaning capabilities; g) it provides a method to introduce solvent cleaning to the process chamber and/or mass flow controller and vaporizers in the event of contamination or plugging; and h) the invention can also be used as a means for introducing solvent into the process chemical source container for container cleaning purposes.

The invention can also be used in a inert gas purge only mode to improve the removal or rapid evaporation of residual higher volatility compounds, such as triethylphosphate or tetraethylorthosilicate, to improve throughput of filling and cleaning processes The present invention has been set forth with regard to one or more preferred embodiments, but the full scope of the present invention should be ascertained from the claims which follow.

We claim:

1. Apparatus for cleaning the interior of a process chemical distribution system, comprising:

a) a process line connected to a source of process chemical and a downstream process chemical use station, said process line having a process valve to control the passage of said process chemical through said process line;

b) a source of solvent capable of at least partially dissolving said process chemical;

c) a vent line connected to said process line, capable of receiving said solvent and having a vent valve for controlling removal of solvent through said vent line; and d) a solvent delivery line connected to said source of solvent and to said process line, having an outlet which is coaxially aligned inside said process line to permit dispensing of solvent from said solvent delivery line into said process line and having a solvent valve for controlling said dispensing of solvent from said source of solvent through said solvent delivery line into said process line.

2. The apparatus of claim 1 wherein said process valve is a first process valve adjacent said source of process chemical and a second process valve adjacent said process chemical use station and said solvent delivery line is connected to said process line between said first and second valve.

3. The apparatus of claim 1 wherein a source of purge gas is controllably connected to said solvent delivery line.

4. The apparatus of claim 3 wherein said solvent delivery line has a first solvent valve adjacent said source of solvent and a second solvent valve adjacent said process line and said source of purge gas is controllably connected to said solvent delivery line between said first and second solvent valve.

5. The apparatus of claim 4 wherein said solvent delivery line has a third solvent valve between said first solvent valve and said source of solvent.

6. The apparatus of claim 5 wherein a second source of vacuum is controllably connected to said solvent delivery line between said third solvent valve and said first solvent valve.

7. The apparatus of claim 1 wherein said vent line is controllably connected to a first source of vacuum.

8. The apparatus of claim 7 wherein a vent storage vessel is controllably connected to said vent line between said process line connection and said first source of vacuum.

9. The apparatus of claim 8 wherein said vent valve has upstream and downstream orifices and said vent storage vessel is controllably connected to said vent line adjacent said upstream orifice and adjacent said downstream orifice.

10. The apparatus of claim 1 wherein said source of solvent is connected to a source of push gas through a push gas valve.

11. Apparatus for cleaning the interior of a process chemical distribution system, comprising:

a) a process line connected to a source of process chemical and a downstream process chemical use station, said process line having a first process valve adjacent said source of process chemical and a second process valve adjacent said process chemical use station to control the passage of said process chemical through said process line;

b) a source of solvent capable of at least partially dissolving said process chemical, said source of solvent connected to a source of push gas through a push gas valve;

c) a vent line connected to said process line, capable of receiving said solvent and having vent valve for controlling removal of solvent through said vent line, said vent valve having upstream and downstream orifices and a vent storage vessel controllably connected to said vent line adjacent said upstream orifice and adjacent said downstream orifice; and d) a solvent delivery line connected to said source of solvent and to said process line, having an outlet which is coaxially aligned inside said process line to permit dispensing of solvent from said solvent delivery line into said process line and having a first solvent valve for controlling said dispensing of solvent from said source of solvent through said solvent delivery line into said process line and having a second solvent valve adjacent said first solvent valve and a third solvent valve adjacent said process line and a source of purge gas is connected to said solvent delivery line between said second and third solvent valve.

12. The apparatus of claim 1 wherein at least a portion of the apparatus is constructed of a material selected from the group consisting of stainless steel, Inconel alloy, titanium, Hastalloy alloy, Teflon plastic, quartz, glass and mixtures thereof.

* * * * *